United States Patent [19]

Adamson

[11] Patent Number: 4,906,958

[45] Date of Patent: Mar. 6, 1990

[54] SNAP-ON FLOATING HANDLE TIE FOR MULTI-POLE CIRCUIT BREAKERS

[75] Inventor: Wayne G. Adamson, Roca, Nebr.

[73] Assignee: Square D Company, Palatine, Ill.

[21] Appl. No.: 265,869

[22] Filed: Nov. 2, 1988

[51] Int. Cl.[4] ..... H01H 75/00

[52] U.S. Cl. ..... 335/11; 200/50 C

[58] Field of Search ..... 335/8–10; 200/50 C

[56] References Cited

U.S. PATENT DOCUMENTS

| | | | |
|---|---|---|---|
| 2,638,012 | 5/1953 | Lewis . | |
| 3,040,140 | 6/1962 | Nimylowycz . | |
| 3,069,517 | 12/1962 | Cole . | |
| 3,158,701 | 11/1964 | Nadeau | 200/50 C |
| 3,213,326 | 10/1965 | Gryctko | 200/50 C |
| 3,240,902 | 3/1966 | Gelzheiser | 200/50 C |
| 4,166,988 | 9/1979 | Ciarcia et al. . | |
| 4,679,016 | 7/1987 | Ciarcia et al. . | |

OTHER PUBLICATIONS

Exhibit A—Brochure of Square D Company.

Exhibit B—1987 Siemens Product Catalog, pp. 312, 317 and 353.

Exhibits C1 and C2—photographs of Square D device.

Exhibits D1 and D2—photographs of Square D Company device.

Exhibits E1 and E2—photographs of Square D Company device.

Exhibits F1 and F2—photographs of Challenger device.

Exhibits G1 and G2—photographs of Siemens Energy & Automation, Inc. device.

Exhibits H1 and H2—photographs of General Electric Company device.

Exhibits I1 and I2—photographs of Bryant Company device.

Exhibits J1 and J2—photographs of Bryant Company device.

Exhibit K—photograph of General Switch Company device.

*Primary Examiner*—Leo P. Picard

*Assistant Examiner*—Lincoln Donovan

*Attorney, Agent, or Firm*—Jose W. Jimenez; Richard T. Guttman; Thomas B. Lindgren

[57] ABSTRACT

A multi-pole circuit breaker apparatus includes first and second circuit breakers having first and second handles extending therefrom for switching the circuit breakers between "On" and "Off" positions. The circuit breakers are connected together with the handles extending generally parallel to each other. A handle tie connects the first and second handles for simultaneous operation. The handle tie has first and second handle openings disposed therethrough. The first and second handles extend all the way through the first and second handle openings, respectively, so that a forwardmost extension of the combined handles and handle tie is no greater than a forwardmost extension of the handles in the absence of the handle tie. The handle tie is slidably received about the handles so that it is free to float along at least a portion of a length of the handles. This provides a multiple circuit breaker apparatus which can readily fit into all existing enclosures in which the circuit breakers could fit in the absence of the handle tie.

16 Claims, 4 Drawing Sheets

SNAP-ON FLOATING HANDLE TIE FOR MULTI-POLE CIRCUIT BREAKERS

This invention relates to electric circuit breakers and is more particularly directed to a handle tie for connecting handles of a plurality of circuit breakers to form a multi-pole circuit breaker.

BACKGROUND OF THE INVENTION

Single pole circuit breakers are often combined to provide multiple pole circuit breakers having two, three or four poles. The individual handles of each of the single pole circuit breakers are typically connected by a handle tie so that all of the handles then operate simultaneously.

The prior art includes a number of different handle tie structures. The most common type of handle tie is an elongated box-shaped structure open along one long side so that the ends of the handles may be received within the box. With these prior art apparatus, the handle tie effectively lengthens the handle by at least the thickness of a wall of the box-shaped handle tie. Such handle ties are attached to the handles by any number of means, including deformed metal tabs, cylindrical pins, button-shaped protrusions which fit in holes in the handles, and the like. These box-shaped handle ties often include windows through which the amperage designation on the outermost end of the handle can be viewed, but the handle does not extend entirely through the handle tie on any of these prior designs.

Although these prior art handle tie structures do effectively join the handles of the circuit breakers so that they operate simultaneously, they have the disadvantage that the handle tie structure protrudes outwardly from the outermost end of the handles, and sometimes interferes with the proper fit of the circuit breaker within an enclosure in which the circuit breaker is received.

SUMMARY OF THE INVENTION

The present invention provides a multiple pole circuit breaker apparatus including at least two circuit breakers arranged in side-by-side relationship with a handle tie connecting the handles of the circuit breakers.

The handle tie has first and second handle openings disposed therethrough within which the handles of the circuit breakers are received. The handles extend all the way through the handle openings so that a forwardmost protrusion of the combined handles and handle tie is no greater than a forwardmost protrusion of the handles in the absence of the handle tie.

The handle tie is slidably received about the handles so that the handle tie is free to float along at least a portion of the handles. When the handle tie is in its outermost position the handles still extend all the way through the handle openings.

An interlocking means is provided for locking the handle tie to the handles and for confining the float of the handle tie between outermost and innermost positions relative to the handles.

This provides a multiple pole circuit breaker apparatus having a handle tie connecting the handles of the circuit breaker without significantly increasing any of the clearances required for satisfactory installation and operation of the circuit breaker. This provides a multiple pole circuit breaker apparatus including a handle tie which can fit in the same enclosures in which the circuit breakers could fit without the handle tie.

Numerous objects, features and advantages of the present invention will be readily apparent to those skilled in the art upon a reading of the following disclosure when taken in conjunction with the accompanying drawings.

DESCRIPTION OF THE PREFERRED EMBODIMENTS

Figure 1:
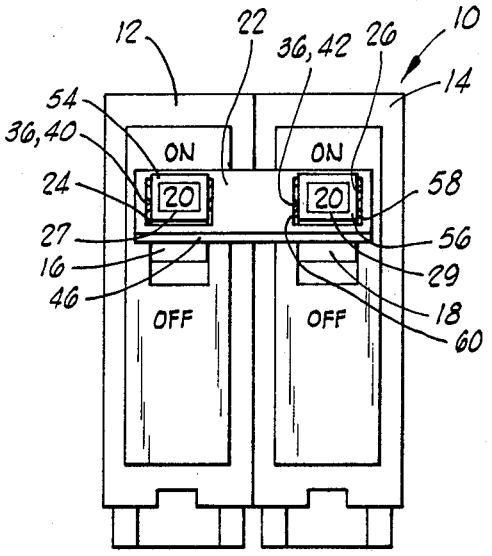
FIG. 1 is a front elevation view of two circuit breakers connected together and having a handle tie associated therewith to form a two-pole circuit breaker.

Referring now to the drawings, and particularly to FIG. 1, a multi-pole circuit breaker apparatus is thereshown and generally designated by the numeral 10. The circuit breaker apparatus 10 shown in FIG. 1 is a two-pole circuit breaker apparatus.

The apparatus 10 includes a first circuit breaker 12 and a second circuit breaker 14 arranged in side-by-side relationship.

The first circuit breaker 12 has a first handle 16 extending therefrom for switching first circuit breaker 12 between "On" and "Off" positions. Second circuit breaker 14 similarly includes a second handle 18.

The first and second circuit breakers 12 and 14 are connected together such as by rivets 20. The first and second handles 16 and 18 extend generally parallel to each other.

The circuit breaker apparatus 10 further includes a handle tie 22 connecting the handles 16 and 18 for simultaneous operation thereof. The handle tie 22 is seen in FIGS. 1–3 as connected to the apparatus 10, and is seen in detail in FIGS. 9–14 separate from the apparatus 10.

The handle tie 22 has first and second handle openings 24 and 26, respectively, disposed therethrough.

Figure 2:
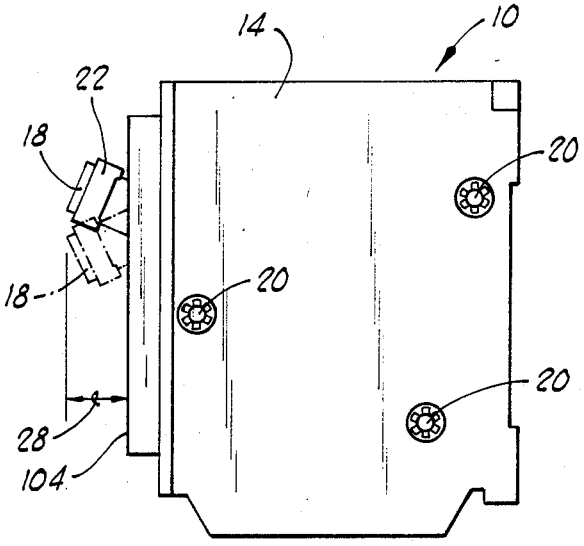
FIG. 2 is a right-side elevation view of the circuit breaker of FIG. 1. The handles are shown in the "On" position in solid lines and the "Off" position in phantom lines.
Figure 3:
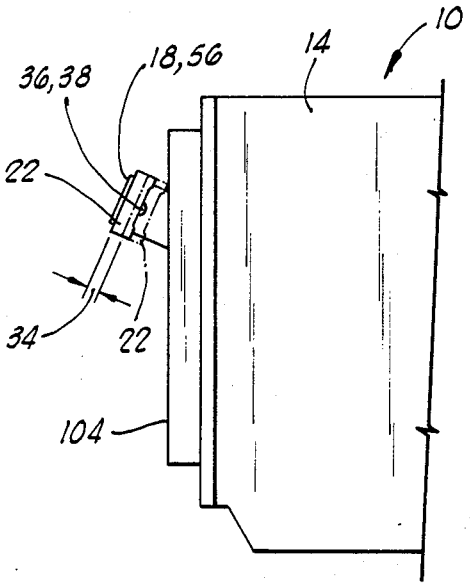
FIG. 3 is a view similar to FIG. 2, showing the handles in the "On" position, with the handle tie shown in its outwardmost position in solid lines, and its inwardmost position in phantom lines.
Figure 4:
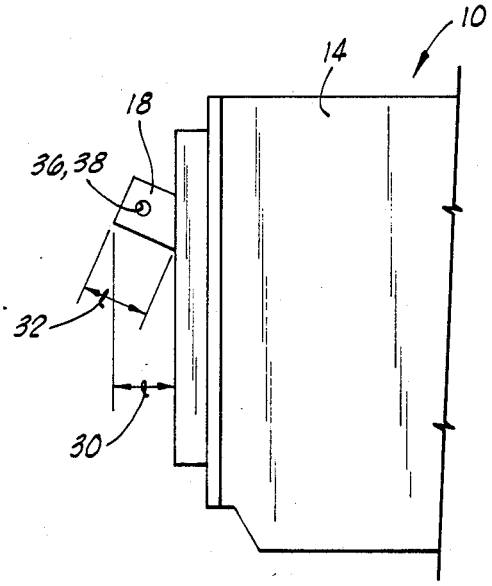
FIG. 4 is another view similar to FIG. 2 showing the handles in the "On" position with the handle tie removed.

As best seen in FIGS. 2 and 3, the handles 16 and 18 extend all the way through the first and second handle openings 24 and 26, respectively, so that a forwardmost extension 28 (see FIG. 2) of the combined handles 16, 18 and handle tie 22 is no greater than a forwardmost extension 30 (see FIG. 4) of said handles 16 and 18 in the absence of handle tie 22.

The amperage indications 27 and 29 which are typically molded into outer end faces 54 and 56 of handles 16 and 18 are clearly visible since the outer end faces 54 and 56 extend all the way through the handle tie 22.

As shown in FIG. 3, it is possible to slide the handle tie 22 to its outwardmost position as shown in solid lines in FIG. 3 wherein the handle tie 22 may extend slightly forward beyond the distance 28 shown in FIG. 2, but that is functionally unimportant since if there is an interference with surrounding structures, the handle tie 22 will merely slide back downward toward its inwardmost position shown in phantom lines in FIG. 3. Therefore, due to the floating arrangement the handle tie 22 does not effectively extend the forwardmost extension distance 28 of the combined handles and handle tie structure.

As is best illustrated in FIG. 3, the handle tie 22 is slidably received about the handles 16 and 18 so that the handle tie 22 is free to float along at least a portion of a length 32 (see FIG. 4) of the handles 16 and 18.

In FIG. 3, the amount of this float is illustrated between the solid and phantom line positions of handle tie 22, which represent the outermost and inwardmost positions of handle tie 22. This float is indicated by the distance 34 which is on the order of about 0.100 inch.

The handles 16 and 18 and handle tie 22 include an interlocking means 36 for locking the handle tie 22 to the handles 16 and 18 and for confining the float 34 of handle tie 22 between the outermost and innermost positions illustrated in FIG. 3.

This interlocking means 36 includes recesses such as 38 disposed in each of the first and second handles 16 and 18, and first and second pairs of protrusions 40 and 42, respectively, extending from the handle tie 22 into the recesses 38. The recesses 38 may be circular holes drilled laterally through the handles 16 and 18.

Figure 13:
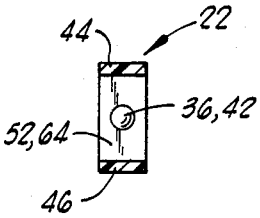
FIG. 13 is a section view of the handle tie of FIG. 9 taken along line 13—13.
Figure 14:
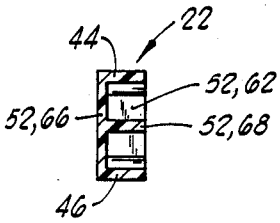
FIG. 14 is another section view of the handle tie of FIG. 9 taken along line 14—14.

As best seen in FIG. 13, the protrusions 40 and 42 are preferably generally circular-shaped rounded bumps which are integrally formed with the handle tie 22 and extend into the openings 24 and 26.

The protrusions 40 and 42 are of smaller diameter than the recesses 38, so that the protrusions 40 and 42 are loosely received in recesses 38 to permit the float 34 of handle tie 22 illustrated in FIG. 3.

The recesses 38 and protrusions 40 and 42 of interlocking means 36 are so dimensioned and arranged that when the handle tie 22 is in its outermost position as illustrated in solid lines in FIG. 3, the handles 16 and 18 still extend all the way through the handle openings 24 and 26, respectively.

Turning now to FIGS. 9–14, the details of construction of the handle tie 22 will be more specifically described. The handle tie 22 is preferably molded from a thermoplastic material as a single integral piece as illustrated in FIGS. 9–14. The handle tie 22 is formed as a structural tie framework 22 including first and second parallel main beams 44 and 46 spanning laterally across the first and second handles 16 and 18.

Figure 9:
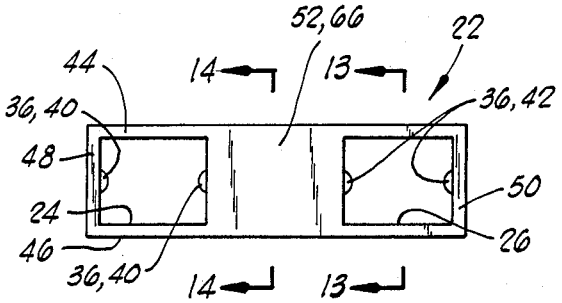
FIG. 9 is a front elevation view of the two-pole handle tie utilized in FIG. 1.
Figure 10:
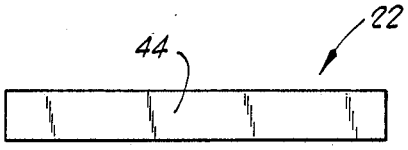
FIG. 10 is a bottom view of the handle tie of FIG. 9.

As seen in FIG. 9, the leftmost ends of the first and second main beams 44 and 46 ar joined by a first cross beam 48 extending therebetween. Similarly, the rightmost ends of main beams 44 and 46 are joined by a second cross beam 50.

An intermediate cross beam structure 52 extends between intermediate portions of first and second main beams 44 and 46.

The first handle opening 24 is thus defined as a rectangular opening 24, defined between first and second main beams 44 and 46, the first cross beam 48, and the intermediate cross beam structure 52. Similarly, the second handle opening 26 is defined between main beams 44 and 46, second cross beam 50 and intermediate cross beam structure 52.

The handle openings 24 and 26 have an inner perimeter of slightly greater dimensions than the rectangular cross section of the handles 16 and 18, and except for the interlocking protrusions 40 and 42, there are no ledges or the like extending into the openings. This is contrasted to typical prior art handle ties which have a closed wall or a ledge or lip which extends over the outer end of the recess within which the handle is received, and which effectively forms an outward extension of the handle.

The first pair of protrusions 40 of interlocking means 36 extend laterally from first cross beam 48 and intermediate cross beam structure 52 into the first opening 24 toward first handle 16. Similarly, the second pair of protrusions 42 extend laterally inwardly into second opening 26 toward second handle 18.

The first and second cross beams 48 and 50 are relatively flexible and thus provide a resilient means operably associated with one of the protrusions of each pair 40 and 42, respectively, for allowing the handle tie 22 to snap in place over handles 16 and 18.

To assemble the handle tie 22 with the handles 16 and 18, the handle tie 22 is placed squarely against the outermost ends 54 and 56 of handles 16 and 18. The pairs of protrusions 40 and 42 initially engage the lateral edges such as 58 and 60 (see FIG. 1) of the outermost ends of the handles.

The application of an inward pressure then causes the first and second cross beams 48 and 50 to flex laterally allowing the handle tie 22 to slide inwardly along handles 16 and 18 until the first and second pairs of protrusions 40 and 42 snap into the recesses 38 of handles 16 and 18, respectively. Thus the handle tie 22 snaps in place over the handles 16 and 18.

It is important that the handle tie 22 be squarely pressed upon the handles 16 and 18 rather than being connected to one handle at a time. The latter approach can partially destroy the protrusions 40 and 42. The handle tie 22 is designed to be assembled one time with the handles 16 and 18, and is not intended to be removed.

The two-pole circuit breaker apparatus 10 illustrated in FIG. 1 can be described as including two and only two circuit breakers, namely the first and second circuit breakers 12 and 14.

The handle tie 22 for the two-pole circuit breaker apparatus 10 includes the previously mentioned cross beam structure 52 which in this embodiment includes third and fourth cross beams 62 and 64 (see FIG. 11) and a reinforcing plate 66 spanning between third and fourth cross beams 62 and 64 and first and second main beams 44 and 46. In the corners where the third and fourth cross beams 62 and 64 adjoin the main beams 44 and 46, there are four rounded pin-shaped structures 67. Cross beam structure 52 further includes a rib 68 extending between third and fourth cross beams 62 and 64 and joined to plate 66. The third and fourth cross beams 62 and 64, reinforcing plate 66, and rib 68 may be collectively referred to as a reinforcing box 69 spanning between first and second main beams 44 and 46.

Figure 5:
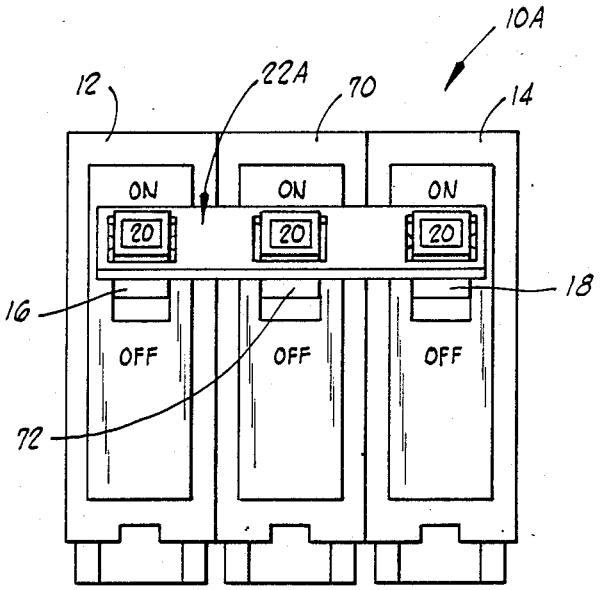
FIG. 5 a front elevation view similar to FIG. 1, showing an embodiment of the present invention with three circuit breakers connected together and utilizing a handle tie to form a three-pole circuit breaker.

FIG. 5 illustrates a three-pole circuit breaker apparatus 10A. The three-pole circuit breaker apparatus 10A includes the first and second circuit breakers 12 and 14, and a third circuit breaker 70 sandwiched therebetween. The third circuit breaker 70 has a third handle 72 extending therefrom. The three-pole circuit breaker apparatus 10A includes a modified handle tie 22A constructed to connect the three handles 16, 18 and 72.

Figure 15:
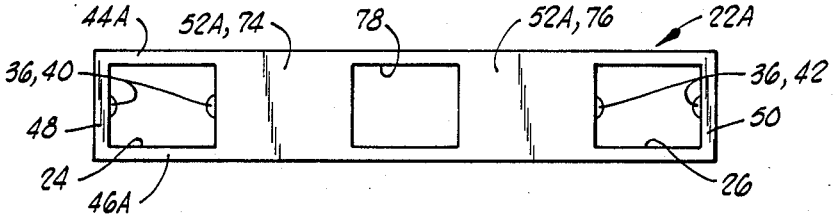
FIG. 15 a front elevation view similar to FIG. 9, showing a three-pole handle tie.

The three-pole handle tie 22A is shown in FIG. 15. It is constructed generally similar to the two-pole handle tie 22, except that the main beams now designated as 44A and 46A have been lengthened, and the intermediate cross beam structure now designated as 52A includes two laterally spaced reinforcing boxes 74 and 76 spanning between the lengthened first and second main beams 44A and 46A thereby defining a third rectangular handle opening 78 between the main beams 44A and 46A and the laterally spaced reinforcing boxes 74 and 76. The third handle 72 extends freely through the third handle opening 78 without any interlocking engagement between third handle 72 and handle tie 22A, since there are no protrusions like protrusions 40 or 42 extending into the third opening 78.

Figure 11:
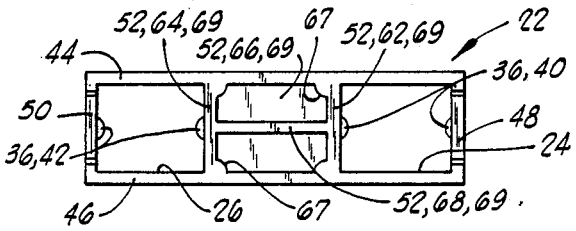
FIG. 11 is a rear elevation view of the handle tie of FIG. 9.
Figure 12:
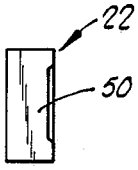
FIG. 12 is a right-side elevation view of the handle tie of FIG. 9.

Each of the reinforcing boxes 74 and 76 is preferably constructed similar to reinforcing box 69 of FIG. 11 in that they will each include a pair of cross beams analogous to third and fourth cross beams 62 and 64, a reinforcing plate analogous to plate 66, and a rib analogous to rib 68.

Figure 6:
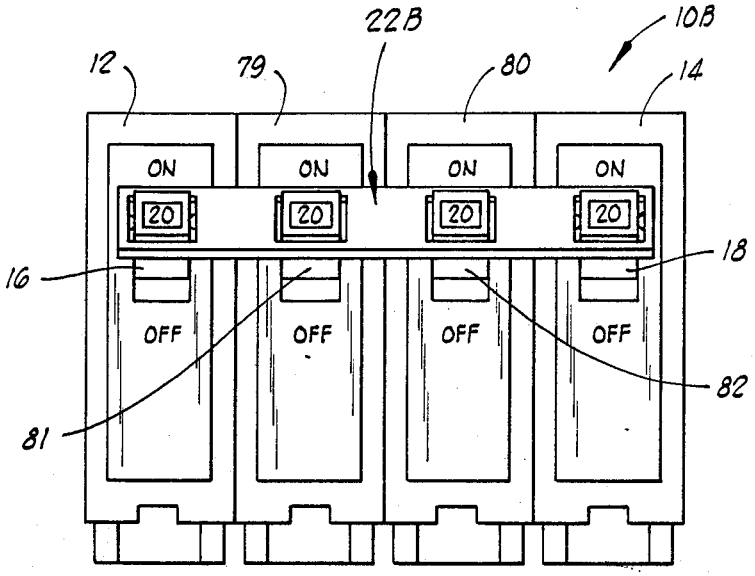
FIG. 6 is a front elevation view similar to FIG. 1, showing an embodiment of the present invention with four circuit breakers connected together and utilizing a handle tie to form a four-pole circuit breaker.

Referring now to FIG. 6, another embodiment of the present invention is illustrated showing a four-pole circuit breaker apparatus 10B. The apparatus 10B includes the first and second circuit breakers 12 and 14, and a third circuit breaker 79 and a fourth circuit breaker 80 both sandwiched between first and second circuit breakers 12 and 14. The third and fourth circuit breakers 79 and 80 include third and fourth handles 81 and 82 extending therefrom.

A modified handle tie 22B connects the handles 16, 18, 81 and 82 in a manner similar to that previously described for the two-pole and three-pole circuit breaker embodiments.

Figure 16:
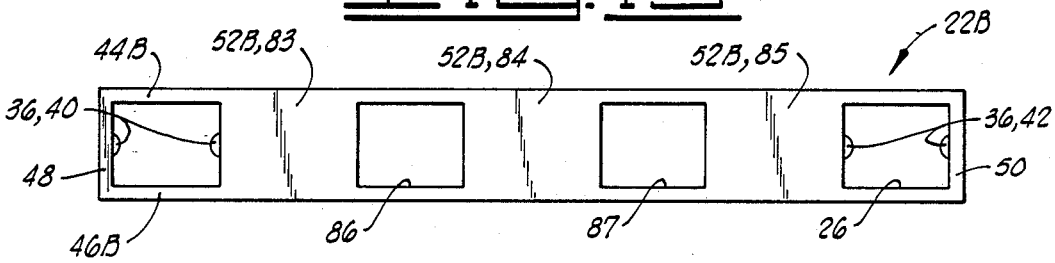
FIG. 16 is a front elevation view, also similar to FIG. 9, showing a four-pole handle tie.

The details of construction of modified handle tie 22B are best seen in FIG. 16.

The first and second main beams, now designated as 44B and 46B, respectively, have again been lengthened. The intermediate cross beam structure now designated as 52B, includes three laterally spaced reinforcing boxes 83, 84 and 85. Third and fourth handle openings 86 and 87 are now defined between main beams 44B and 46B, and reinforcing boxes 83, 84 and 85.

The third and fourth handle openings 86 and 87 do not include any interlocking protrusions, and thus the third and fourth handles 81 and 82 are also freely received within handle openings 86 and 87.

Figure 7:
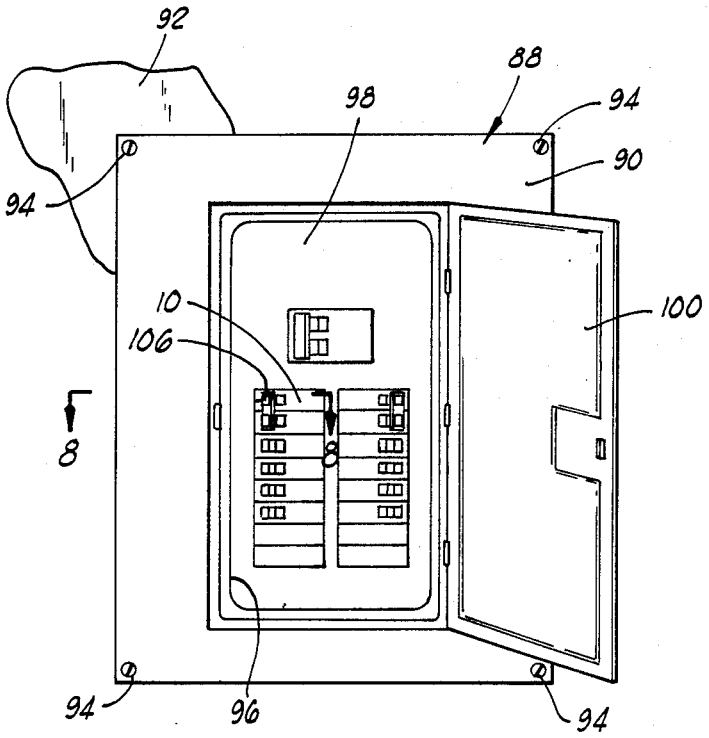
FIG. 7 is an elevation view of a typical wall panel enclosure for receiving a plurality of circuit breakers. Circuit breakers similar to those in FIG. 1 are shown in place within the enclosure. The circuit breakers have been rotated 90° relative to the orientation shown in FIG. 1.
Figure 8:
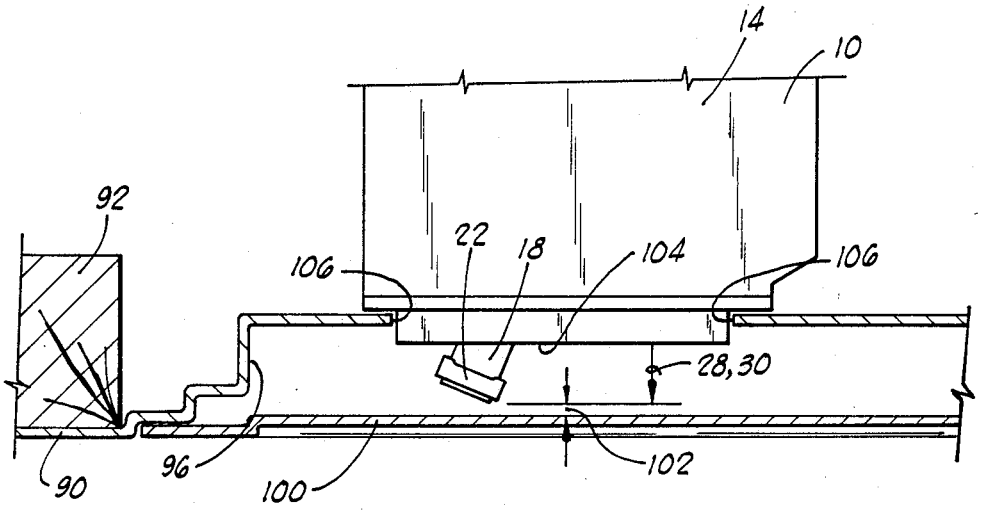
FIG. 8 is a plan section view taken along line 8—8 of FIG. 7, showing the typical clearance between the circuit breaker handles and the door of the wall panel enclosure.

Referring now to FIGS. 7 and 8, the advantages of the circuit breaker apparatus and handle tie structure of the present invention will be described.

Circuit breaker apparatus such as any of the apparatus 10, 10A or 10B are typically located within a wall-mounted enclosure such as 88. The enclosure 88 will include a panel such as 90 attached to a wall such as 92 by a plurality of fasteners 94.

The enclosure 88 includes a box-shaped recess having perimeter 96, rear wall 98, and a hinged forward door panel 100.

FIG. 7 illustrates a plurality of circuit breakers, one of which is designated as being the circuit breaker 10 of FIG. 1, mounted within the rear wall 98 of the enclosure.

As best seen in FIG. 8, which is a plan section view taken along line 8—8 of FIG. 7, when the door panel 100 is in a closed position as illustrated in FIG. 8, there typically is only a very small clearance indicated at 102 between the door panel 100 and the handle 18 of the circuit breaker 10.

With the handle tie 22 of the present invention which allows the handles 16 and 18 to extend entirely therethrough, and which floats upon the handles 16 and 18, the forwardmost protrusion 28 of the combined handles 16, 18 and handle tie 22 is the same as the forwardmost protrusion 30 which would exist without the handle tie 22, so that the handle tie 22 does not interfere with closure of the door panel 100.

Typical prior art handle ties which cover the ends of the handles will have a material thickness on the order of 0.040-0.060 inches, and the clearance 102 is often not large enough to accommodate that extension of the handle length. With commonly used enclosures 88, the clearance 102 will typically be in the range of from 0.010 to 0.125 inches.

Also, the floating design of the handle tie 22 insures that the handle tie 22 does not interfere with movement of the handles 16 and 18 to their "On" and "Off" positions.

As is apparent in FIGS. 2, 3 and 8, the inwardmost position of the handle tie 22 will generally engage a forward face 104 of the circuit breakers 12 and 14, but since the handle tie 22 can slide outward along the handles 16 and 18, there is no danger of the handle tie 22 holding the handles 16 and 18 slightly out of a completely "On" or "Off" position.

If the handle tie 22 were merely pinned in place at a location approximating its inwardmost position, then due to dimensional tolerances and the like there would be a danger that in some installations the handle tie would hold the handle slightly off of the "On" position which would change the contact position within the circuit breaker which is undesirable.

As will be understood by those skilled in the art, it would be very undesirable for the handles to be held away from their fully "On" or "Off" positions.

Additionally, as is best seen in FIG. 2, the handle tie 22 does not extend significantly above or below the upwardmost or lowermost extremities of the outer end 56 of handle 18 when the handle is in its "On" or "Off" positions, respectively. The terms upwardmost and lowermost with reference to FIG. 2 are described in the context of an installation where FIG. 2 would be a side elevation view with the handles 16 and 18 rotating about a horizontal axis extending out of the plane of the paper. It will be understood that these reference terms "upwardmost" and "lowermost" must be considered in context, and when applied to an installation such as that shown in FIG. 7 where the circuit breakers have been laid on their sides, the proper terms would be leftmost or rightmost rather than upwardmost and lowermost.

As is apparent in FIGS. 7 and 8, the openings such as 106 within which the circuit breakers are received are also relatively close fits, and thus this space-saving feature of the handle tie 22 may also often be important.

Thus it is seen that the apparatus of the present invention readily meets the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention as defined by the appended claims.

What is claimed is:

1. A multi-pole circuit breaker apparatus, comprising:

a first circuit breaker having a first handle extending therefrom for switching said first circuit breaker between "On" and "Off" positions;

a second circuit breaker having a second handle extending therefrom for switching said second circuit breaker between "On" and "Off" positions, said first and second circuit breakers being connected together with said first and second handles extending generally parallel to each other;

a handle tie connecting said first and second handles for simultaneous operation thereof, said handle tie having first and second handle openings disposed therethrough, said handle tie including:

first and second parallel main beams spanning laterally across said first and second handles;

a first cross beam extending between ends of said first and second main beams adjacent said first handle;

a second cross beam extending between other ends of said first and second main beams adjacent said second handle;

an intermediate cross beam structure extending between intermediate portions of said first and second main beams;

wherein said first handle opening is a rectangular opening defined between said first and second main beams, said first cross beam and said intermediate cross beam structure; and wherein said second handle opening is a rectangular opening defined between said first and second main beams, said second cross beam and said intermediate cross beam structure; and wherein said first and second handles extend all the way through said first and second handle openings, respectively, so that a forwardmost extension of said combined handles and handle tie is no greater than a forwardmost extension of said handles in the absence of said handle tie.

2. The apparatus of claim 1, wherein:

said handle tie is slidably received about said first and second handles so that said handle tie is free to float along at least a portion of a length of said handles.

3. The apparatus of claim 2, wherein:

said handles and said handle tie include interlocking means for locking said handle tie to said handles and for confining said float of said handle tie between outermost and innermost positions of said handle tie relative to said handles.

4. The apparatus of claim 3, wherein:

said interlocking means is further characterized in that when said handle tie is in its said outermost position said handles still extend all the way through said handle openings.

5. The apparatus of claim 3, wherein:

said interlocking means includes first and second recesses disposed in said first and second handles, respectively, and first and second protrusions extending from said handle tie into said first and second recesses, respectively, said protrusions being loosely received in said recesses to permit said float of said handle tie on said handles.

6. The apparatus of claim 5, wherein:

said handle tie includes resilient means, operably associated with said first and second protrusions, for allowing said handle tie to snap in place over said handles.

7. The apparatus of claim 6, wherein:

said first and second protrusions extend laterally inwardly from said first and second cross beams toward said first and second handles, respectively, said first and second cross beams being relatively flexible and thus providing said resilient means.

8. The apparatus of claim 1, wherein:

said apparatus is further characterized as including two and only two circuit breakers, said two circuit breakers being said first and second circuit breakers; and said intermediate cross beam structure includes:

third and fourth cross beams;

a reinforcing plate spanning between said third and fourth cross beams and said first and second main beams; and a rib extending between said third and fourth cross beams and joined to said plate.

9. The apparatus of claim 1, wherein:

said apparatus is further characterized as including three and only three circuit breakers, said three circuit breakers being said first and second circuit breakers and a third circuit breaker sandwiched between said first and second circuit breakers, said third circuit breaker having a third handle extending therefrom;

said intermediate cross beam structure includes two laterally spaced reinforcing boxes spanning between said first and second main beams thereby defining a third rectangular handle opening between said first and second main beams and said two laterally spaced reinforcing boxes; and said third handle extends freely through said third handle opening without any interlocking engagement between said third handle and said handle tie.

10. The apparatus of claim 1, wherein:

said apparatus is further characterized as including four and only four circuit breakers, said four circuit breakers being said first and second circuit breakers and a third and a fourth circuit breaker both sandwiched between said first and second circuit breakers, said third and fourth circuit breakers having third and fourth handles, respectively, extending therefrom;

said intermediate cross beam structure includes three laterally spaced reinforcing boxes spanning between said first and second main beams thereby defining third and fourth rectangular handle openings; and said third and fourth handles extend freely through said third and fourth handle openings, respectively, without any interlocking engagement of either said third or fourth handle and said handle tie.

11. A handle tie apparatus for connecting generally parallel handles of at least two circuit breakers arranged in side-by-side relationship, comprising:

a structural tie framework having a plurality of handle openings disposed therethrough, one opening for each of said handles, said framework and openings being so arranged and constructed that said framework may be received about said handles with each of said handles extending all the way through a respective one of said handle openings so that a forwardmost extension of said combined handles and handle tie apparatus is no greater than a forwardmost extension of said handles in the absence of said handle tie apparatus, said framework including:

first and second parallel main beam means for spanning laterally across said handles;

a first cross beam extending between ends of said first and second main beam means;

a second cross beam extending between other ends of said first and second main beam means;

an intermediate cross beam structure extending between intermediate portions of said first and second main beam means;

wherein a first one of said handle openings is a rectangular opening defined between said first and second main beam means, said first cross beam and said intermediate cross beam structure; and wherein a second one of said handle openings is a rectangular opening defined between said first and second main beam means, said second cross beam and said intermediate cross beam structure.

12. The apparatus of claim 11, wherein:

said apparatus is further characterized as being a handle tie apparatus for connecting handles of two and only two circuit breakers; and said intermediate cross beam structure includes:

third and fourth cross beams;

a reinforcing plate spanning between said third and fourth cross beams and said first and second main beam means; and a rib extending between said third and fourth cross beams and joined to said plate.

13. The apparatus of claim 11, wherein:

said apparatus is further characterized as being a handle tie apparatus for connecting handles of three and only three circuit breakers;

said apparatus further includes interlocking means for locking said framework to first and second ones of said handles extending through said first and second handle openings, respectively; and said intermediate cross beam structure includes two laterally spaced reinforcing boxes spanning between said first and second main beam means thereby defining a third rectangular handle opening between said first and second main beam means and said two laterally spaced reinforcing boxes, said third handle opening being constructed to freely receive a third handle freely therethrough without any interlocking engagement between said third handle and said framework.

14. The apparatus of claim 11, wherein:

said apparatus is further characterized as being a handle tie apparatus for connecting handles of four and only four circuit breakers;

said apparatus further includes interlocking means for locking said framework to first and second ones of said handles extending through said first and second handle openings respectively; and said intermediate cross beam structure includes three laterally spaced reinforcing boxes spanning between said first and second main beam means thereby defining third and fourth rectangular handle openings constructed to freely receive third and fourth handles, respectively, without any interlocking engagement of either said third or fourth handles with said framework.

15. The apparatus of claim 11, further comprising:

interlocking means for locking said framework to said handles while still permitting said framework to float along at least a portion of a length of said handles.

16. The apparatus of claim 15, wherein:

said interlocking means includes first and second pairs of protrusions extending from said framework into said first and second handle openings, said first and second pairs of said protrusions being arranged to be received in recesses in said handles; and said first and second cross beams are further characterized as resilient means associated with said first and second pairs of protrusions for allowing said framework to snap in place over said handles.

* * * * *